US010285547B2

(12) United States Patent
Chen et al.

(10) Patent No.: US 10,285,547 B2
(45) Date of Patent: May 14, 2019

(54) TOILET COVER AND METHOD FOR DEMOUNTING AND INSTALLING UPPER COVER ASSEMBLY OF TOILET COVER

(71) Applicant: XIAMEN AXENT CORPORATION LIMITED, Xiamen (CN)

(72) Inventors: Lianjin Chen, Xiamen (CN); Zijie Cai, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 0 days.

(21) Appl. No.: 15/557,057

(22) PCT Filed: Mar. 15, 2016

(86) PCT No.: PCT/CN2016/076324
§ 371 (c)(1),
(2) Date: Sep. 8, 2017

(87) PCT Pub. No.: WO2016/146051
PCT Pub. Date: Sep. 22, 2016

(65) Prior Publication Data

US 2018/0064300 A1 Mar. 8, 2018

(30) Foreign Application Priority Data

Mar. 17, 2015 (CN) ..... 2015 1 0116584

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26; A47K 13/28
See application file for complete search history.

(56) References Cited

U.S. PATENT DOCUMENTS 4,197,596 A 4/1980 Fantetti
5,901,383 A 5/1999 Yanagawa
(Continued)

FOREIGN PATENT DOCUMENTS

CN 201624595 U 11/2010
CN 203524570 U 4/2014
(Continued)

OTHER PUBLICATIONS

International Search Report for PCT/CN2016/076324 dated Jun. 6, 2016; 12 pages, including English translation.
(Continued)

*Primary Examiner* — Janie M Loeppke
(74) *Attorney, Agent, or Firm* — Schwabe Williamson & Wyatt, PC

(57) ABSTRACT

A toilet seat includes a main body; a cover assembly detachably connected to the main body and rotatable with respect to the main body; a connecting mechanism arranged between the main body and the cover assembly and detachably connecting the cover assembly to the main body, and the connecting mechanism includes a bushing arranged in the main body, the bushing and the main body form an engagement slot, and a rotating shaft extendable and retractable with respect to the cover assembly, an end of the rotating shaft is provided with an engagement portion, and in a case that the rotating shaft extends out with respect to the cover assembly, the engagement portion is in engagement with the engagement slot to fix the cover assembly to the main body.

9 Claims, 13 Drawing Sheets

(56) References Cited

U.S. PATENT DOCUMENTS

| | | | | |
|---|---|---|---|---|
| 6,026,520 | A * | 2/2000 | Pedersen | A47K 13/12 4/236 |
| 2016/0015226 | A1 | 1/2016 | Chen | |

FOREIGN PATENT DOCUMENTS

| | | | |
|---|---|---|---|
| CN | 104095581 | A | 10/2014 |
| CN | 204091873 | U | 1/2015 |
| DE | 102006020205 | A1 | 11/2007 |
| JP | H1128175 | A | 2/1999 |
| WO | 2016/146051 | A1 | 9/2016 |

OTHER PUBLICATIONS

European Search Report for EP Application No. 16764231.3 dated Oct. 5, 2018; 8 pages.

* cited by examiner

TOILET COVER AND METHOD FOR DEMOUNTING AND INSTALLING UPPER COVER ASSEMBLY OF TOILET COVER

CROSS-REFERENCE TO RELATED APPLICATIONS

This application is the national phase of International Application No. PCT/CN2016/076324, titled "TOILET COVER AND METHOD FOR DEMOUNTING AND INSTALLING UPPER COVER ASSEMBLY OF TOILET COVER", filed on Mar. 15, 2016, which claims the benefit of priority to Chinese Patent Application No. 201510116584.3, titled "TOILET SEAT AND METHOD FOR DETACHING AND INSTALLING COVER ASSEMBLY OF TOILET SEAT", filed with the State Intellectual Property Office of People's Republic of China on Mar. 17, 2015, the entire disclosures of which are incorporated herein by reference.

FIELD

This application relates to the field of sanitary ware, and in particular to a toilet seat with a fast detachable and installable cover assembly and a method for detaching and installing the cover assembly of the toilet seat fast.

BACKGROUND

At present, for most toilet seats in the market, a toilet seat cover and/or a toilet seat ring are fixed to a toilet seat body. The toilet seat cover and/or the toilet seat ring of some toilet seats can be detached fast, however, the detachment process is complicated, and even for some easy detachable toilet seats, it is required to press a button or flip a switch, which causes inconveniences to detachment and installment of the toilet seat cover and/or the toilet seat ring.

TECHNICAL ISSUE

At present, for most toilet seats in the market, a toilet seat cover and/or a toilet seat ring are fixed to a toilet seat body. The toilet seat cover and/or the toilet seat ring of some toilet seats can be detached fast, however, the detachment process is complicated, and even for some easy detachable toilet seats, it is required to press a button or flip a switch, which causes inconveniences to detachment and installment of the toilet seat cover and/or the toilet seat ring.

SOLUTION TO THE TECHNICAL ISSUE

Technical Solution

In view of defects in the conventional technology, an object of the present application is to provide a toilet seat and a method for detaching and installing a cover assembly of the toilet seat. The cover assembly of the toilet seat is fast detachable and installable, and it is not required to press any switches in the detaching process.

A toilet seat is provided according to an aspect of the present application, and the toilet seat includes: a main body; a cover assembly detachably connected to the main body and rotatable with respect to the main body; a connecting mechanism arranged between the main body and the cover assembly; wherein the connecting mechanism is configured to detachably connect the cover assembly to the main body, and the connecting mechanism includes a bushing arranged in the main body, wherein the bushing and the main body form an engagement slot, and the engagement slot has a main body portion formed by the main body and the main body portion is provided with a first beveled opening; and a rotating shaft extendable and retractable with respect to the cover assembly, wherein an end of the rotating shaft is provided with an engagement portion, and in a case that the rotating shaft extends out with respect to the cover assembly, the engagement portion is in engagement with the engagement slot to fix the cover assembly to the main body.

Preferably, the connecting mechanism further includes an elastic component, and the elastic component has one end fixedly connected to the rotating shaft and another end fixedly connected to the cover assembly, to allow the rotating shaft to extend out with respect to the cover assembly under the action of the elastic component.

Preferably, the elastic component is a spring, and the spring has one end connected to the cover assembly and another end connected to the rotating shaft.

Preferably, the first beveled opening is arranged in a detachment direction of the engagement slot, and in a case that the rotating shaft moves upward in the detachment direction along with the cover assembly, the first beveled opening is configured to guide the rotating shaft to retract into the cover assembly.

Preferably, the rotating shaft is provided with a second beveled opening, and the second beveled opening is configured to cooperate with the first beveled opening to allow the rotating shaft to retract into the cover assembly.

Preferably, the connecting mechanism further includes a bushing, and the bushing is provided with a third beveled opening, and the third beveled opening is configured to cooperate with the first beveled opening to allow the rotating shaft to retract into the cover assembly.

Preferably, a position-limiting groove is provided at a joint where the cover assembly is connected to the main body and is arranged in a transverse direction of the cover assembly, and the elastic component and the rotating shaft are located in the position-limiting groove.

Preferably, the rotating shaft is rotatable synchronously with the cover assembly.

A method for detaching the cover assembly of the toilet seat described above is provided according to another aspect of the present application, and the method includes the following steps: rotating the cover assembly to a detachment position; and moving the cover assembly upward in the detachment direction, wherein in a process that the cover assembly is moved upward, the rotating shaft is moved upward along with the cover assembly to be retracted into the cover assembly, and then the cover assembly is not connected to the main body to allow the cover assembly to be detached from the main body.

A method for installing the cover assembly of the toilet seat described above is provided according to yet another aspect of the present application, and the method includes the following steps: moving the rotating shaft and maintaining the rotating shaft within the cover assembly; placing the cover assembly above a joint between the main body and the cover assembly; and moving the cover assembly downward in the detachment direction, wherein in a process that the cover assembly is moved downward in the detachment direction, the rotating shaft is moved downward along with the cover assembly to extend out of the cover assembly and the engagement portion of the rotating shaft is located in the engagement slot, to connect the cover assembly to the main body in an engagement manner.

BENEFICIAL EFFECTS OF THE PRESENT APPLICATION

Beneficial Effects

The toilet seat according to the present application enables a fast detachment and installment of the cover assembly with respect to the main body by providing the connecting mechanisms between the cover assembly and the main body. Therefore, the toilet seat has advantages such as having a high installation efficiency, being convenient for clearing hidden dirt and its cover assembly being easy to detach in maintenance.

BRIEF DESCRIPTION OF THE DRAWINGS

Description of the Drawings

In conjunction with the detailed description of non-limitative embodiments with reference to the drawings, other features, objects and advantages of the present application will become apparent.

Figure 1:
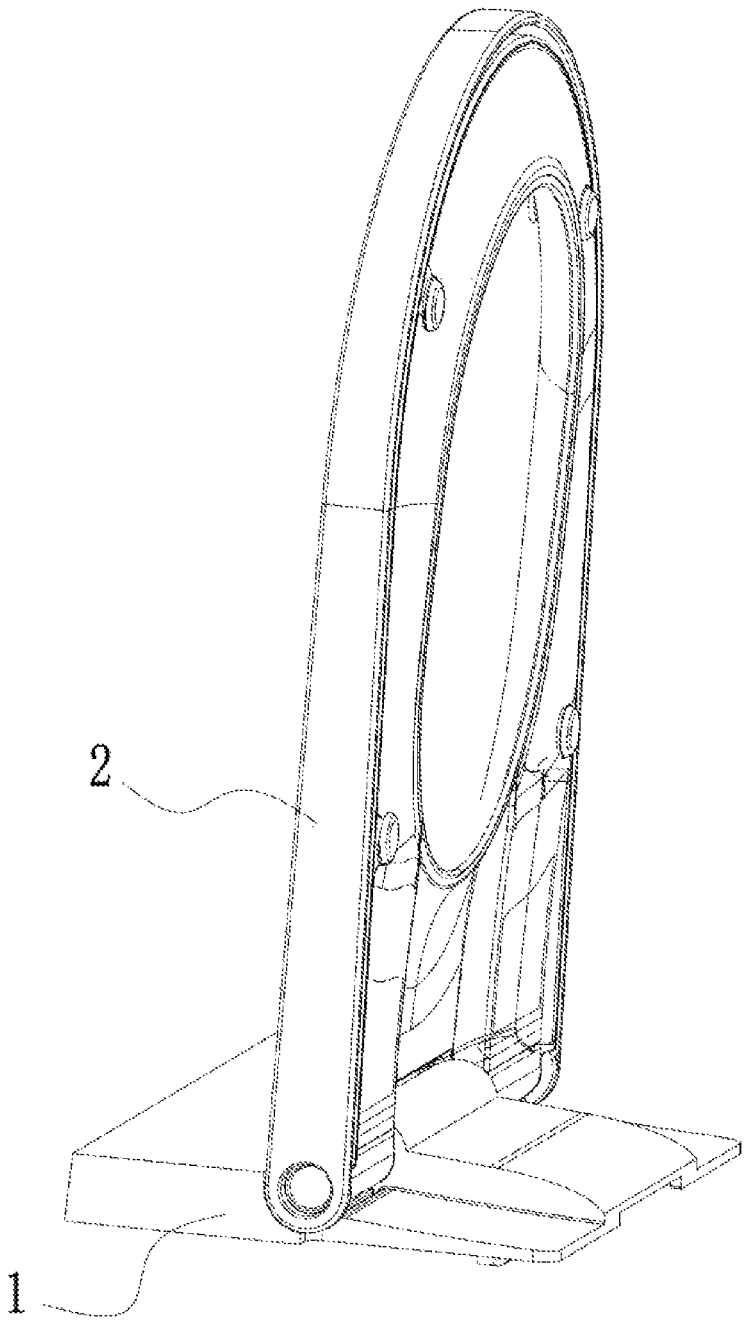
Figure 2:
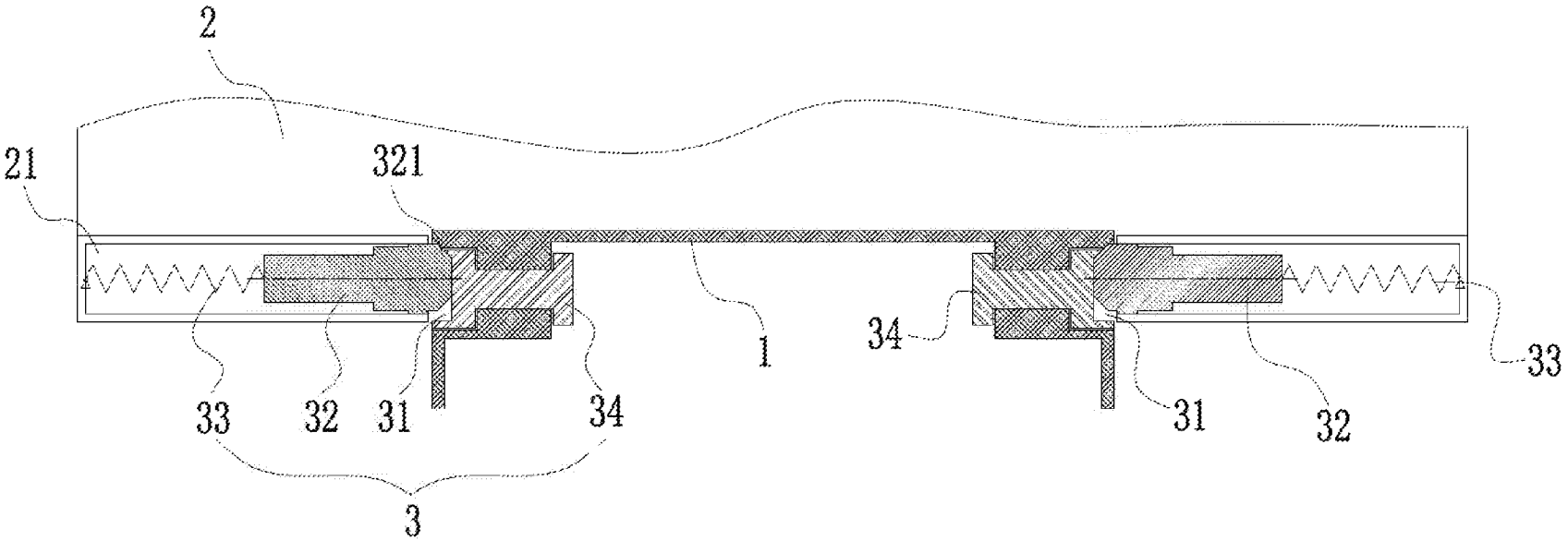
Figure 3:
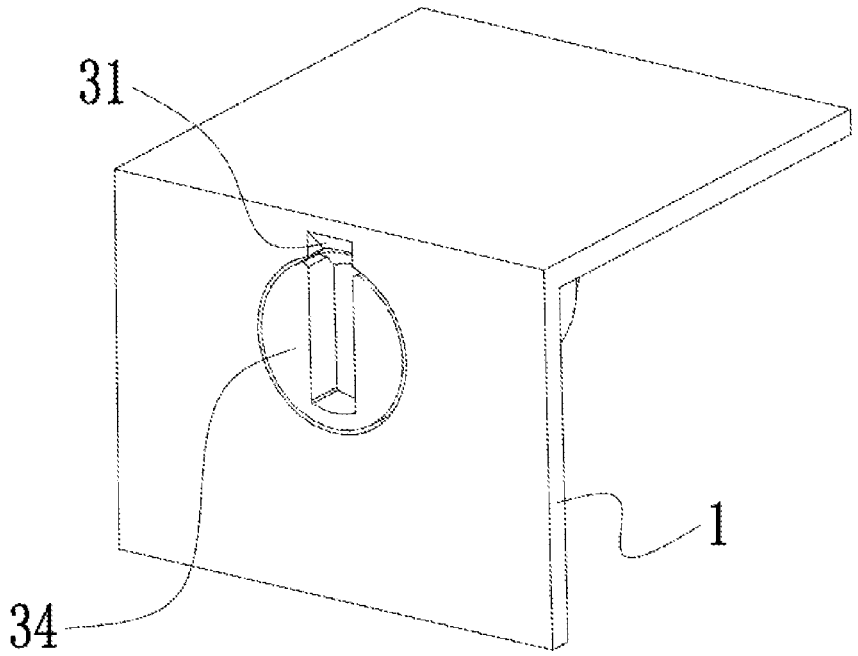
Figure 4:
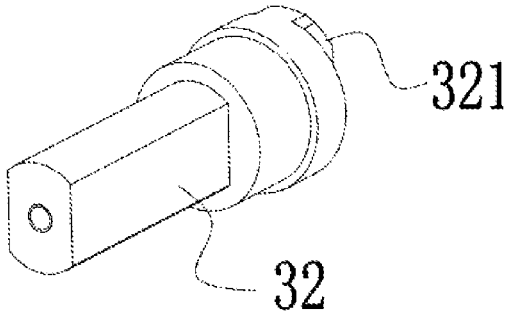
Figure 5:
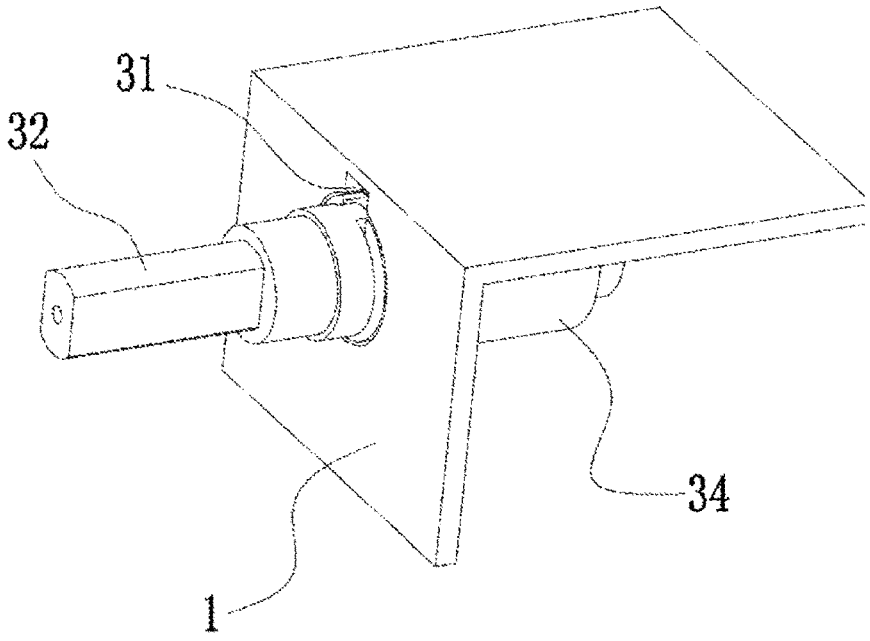
Figure 6:
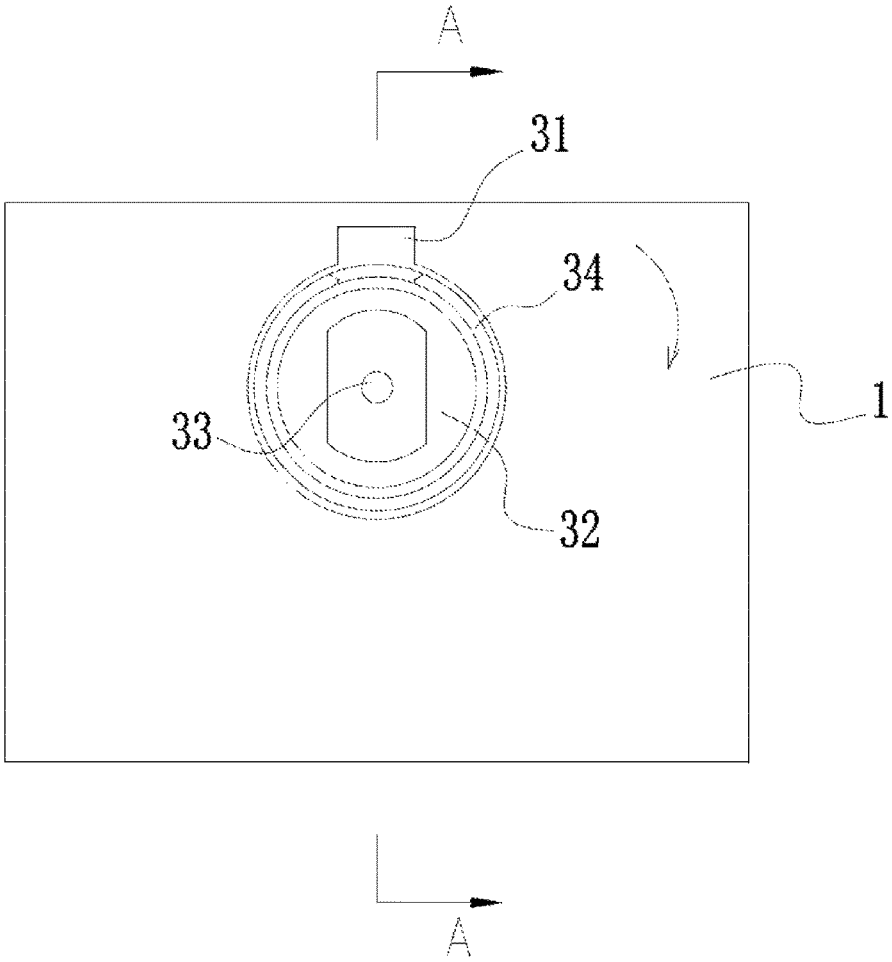
Figure 7:
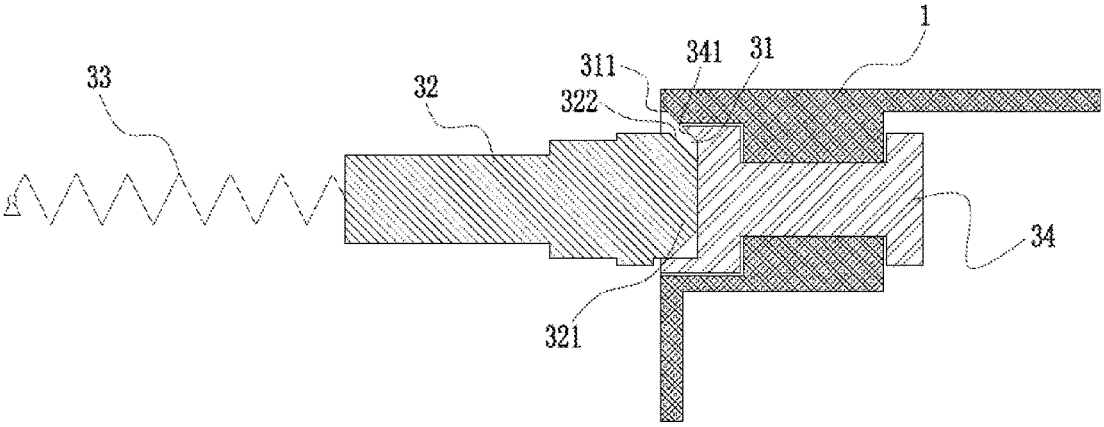
Figure 8:
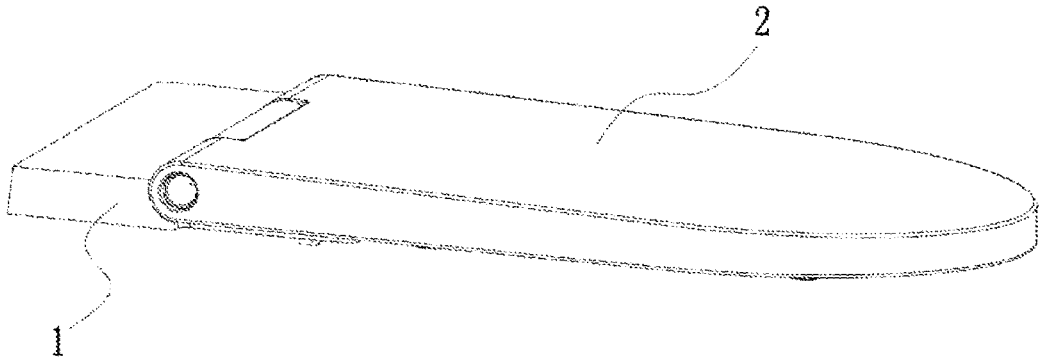
Figure 9:
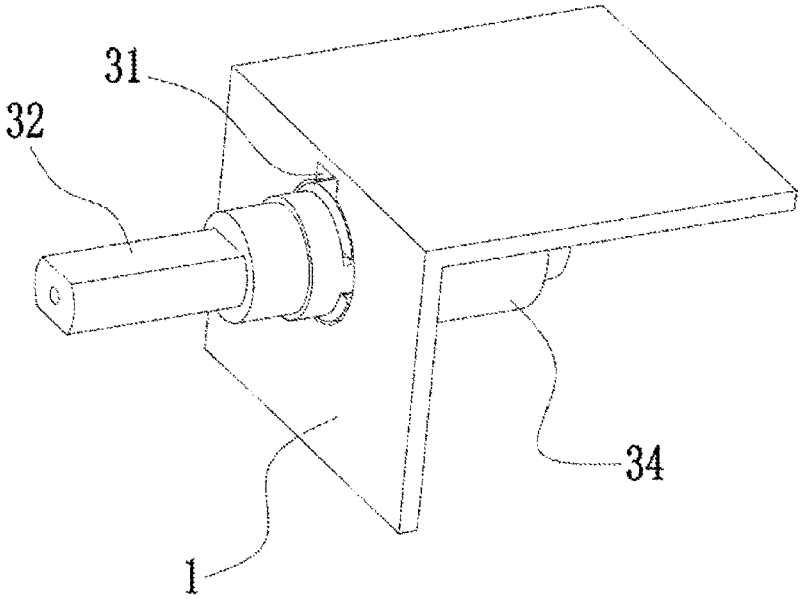
Figure 10:
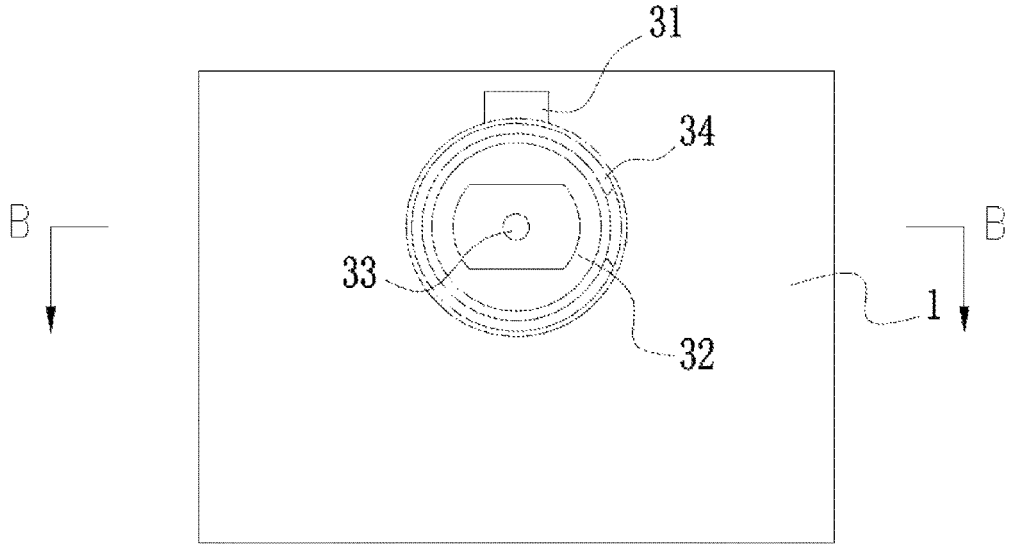
Figure 11:
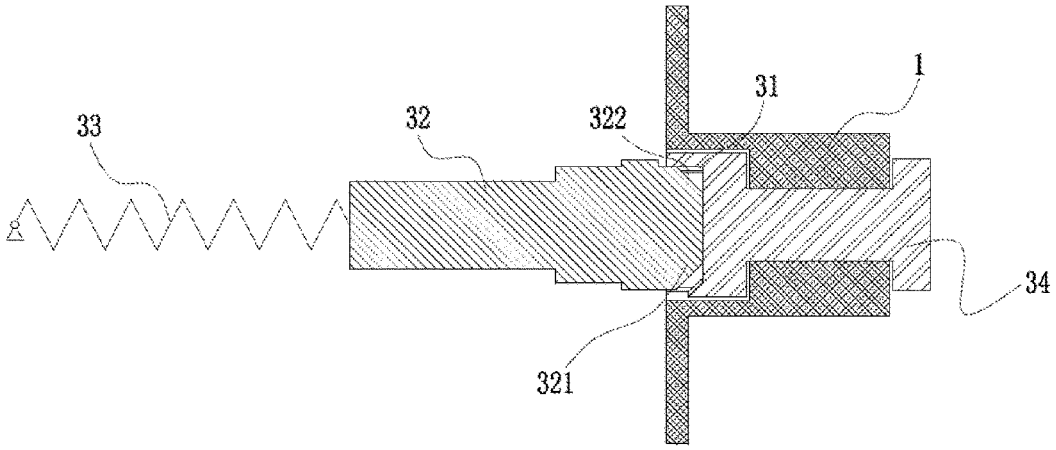
Figure 12:
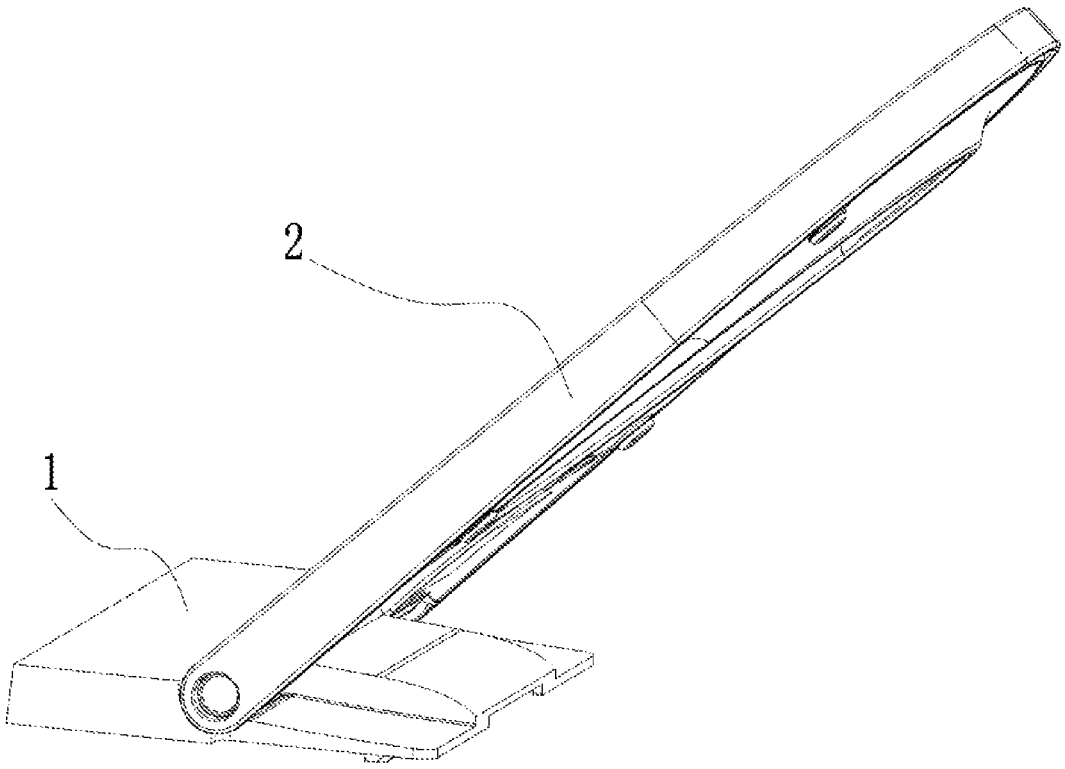
Figure 13:
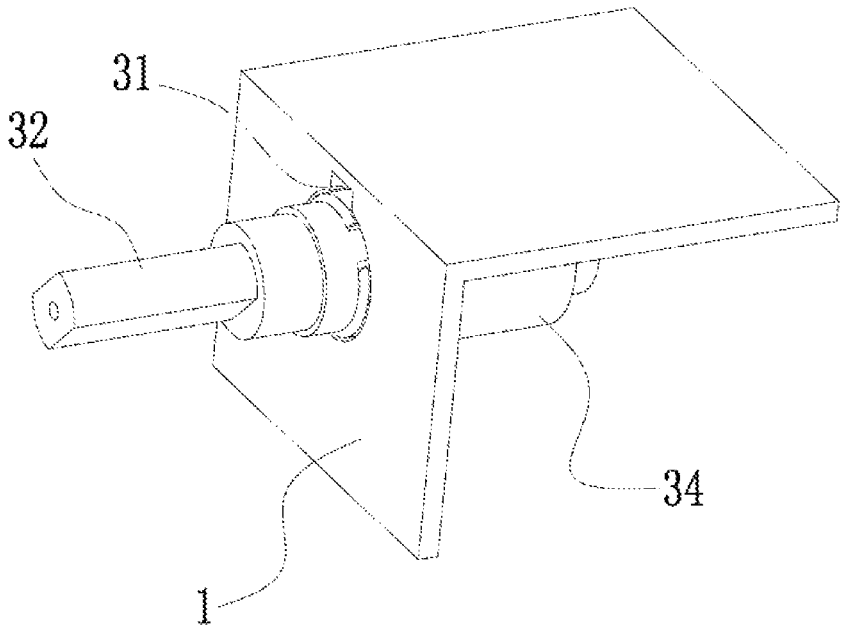
Figure 14:
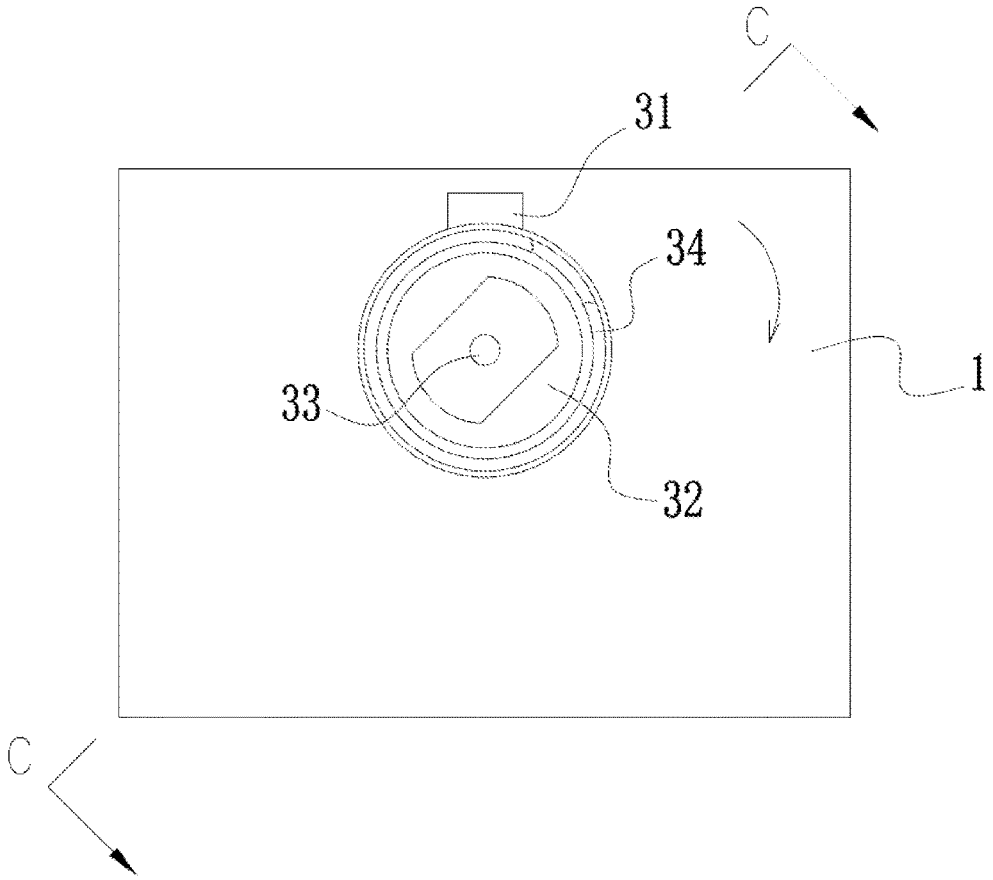
Figure 15:
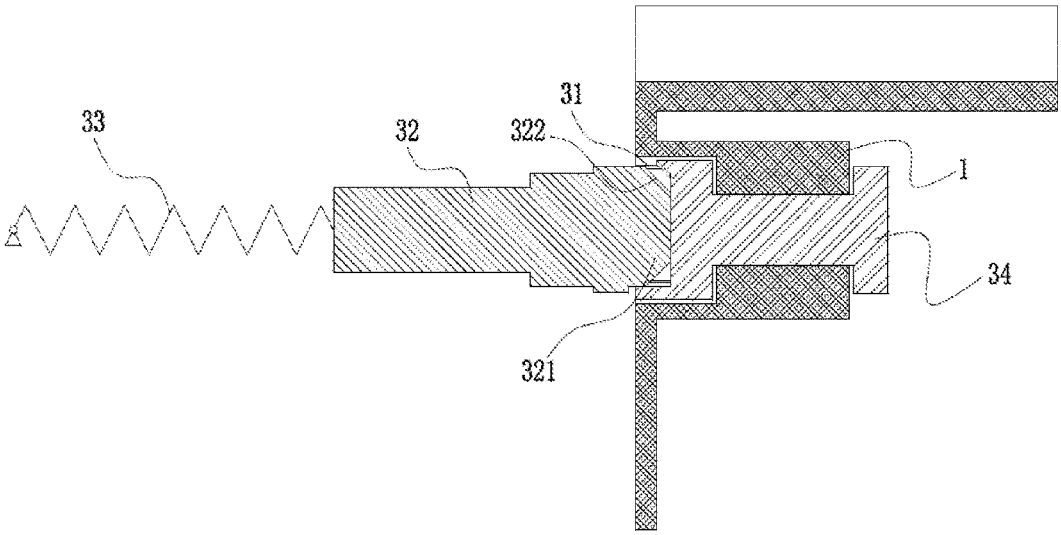
Figure 16:
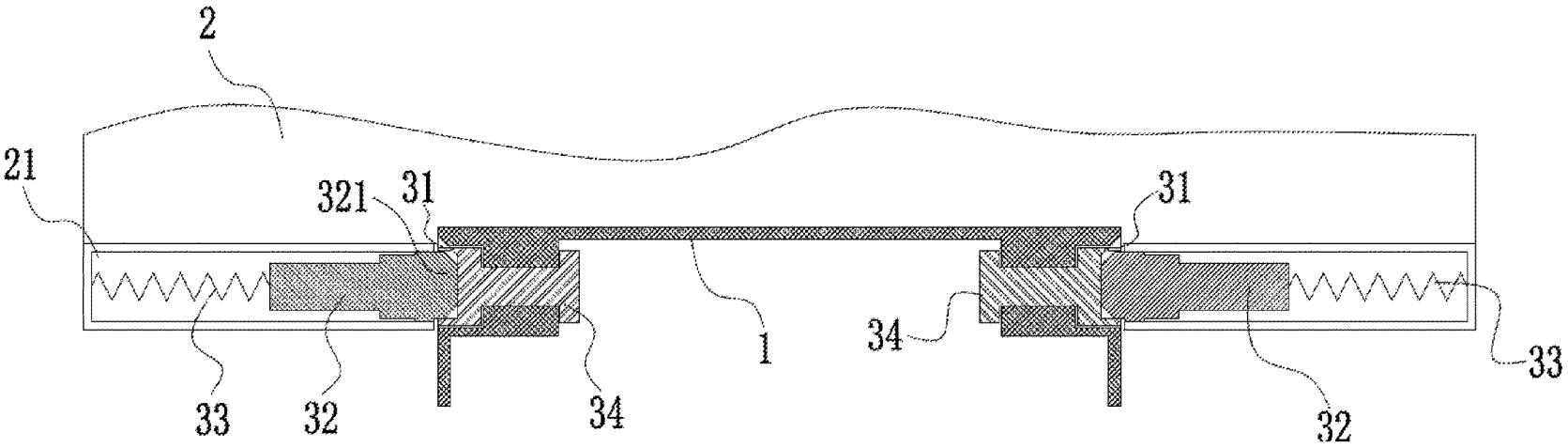
Figure 17:
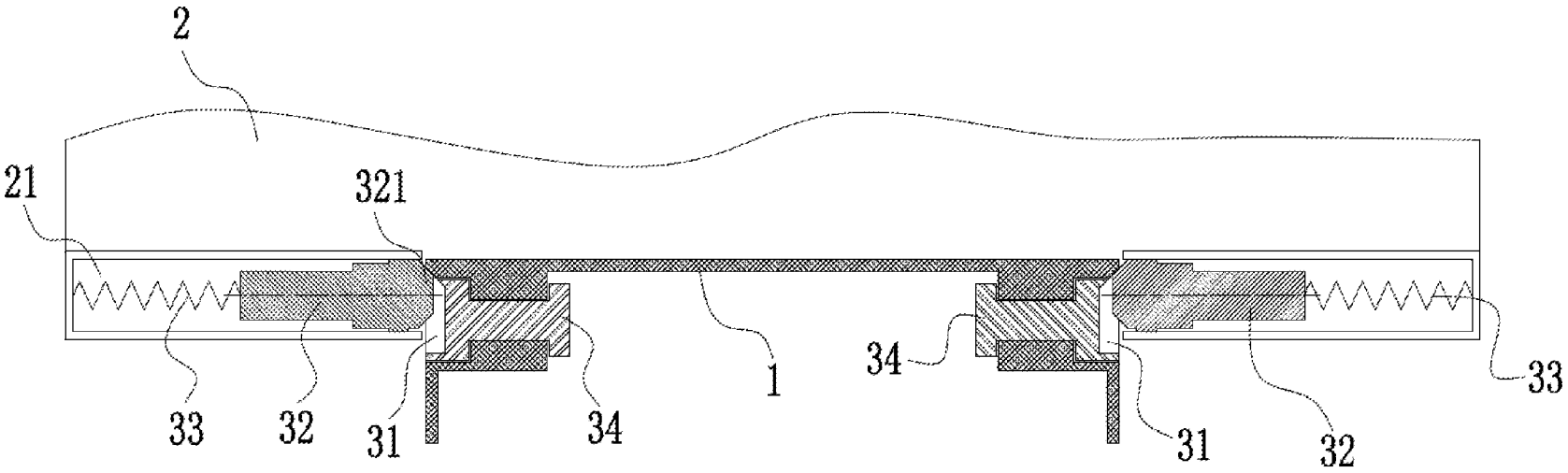
Figure 18:
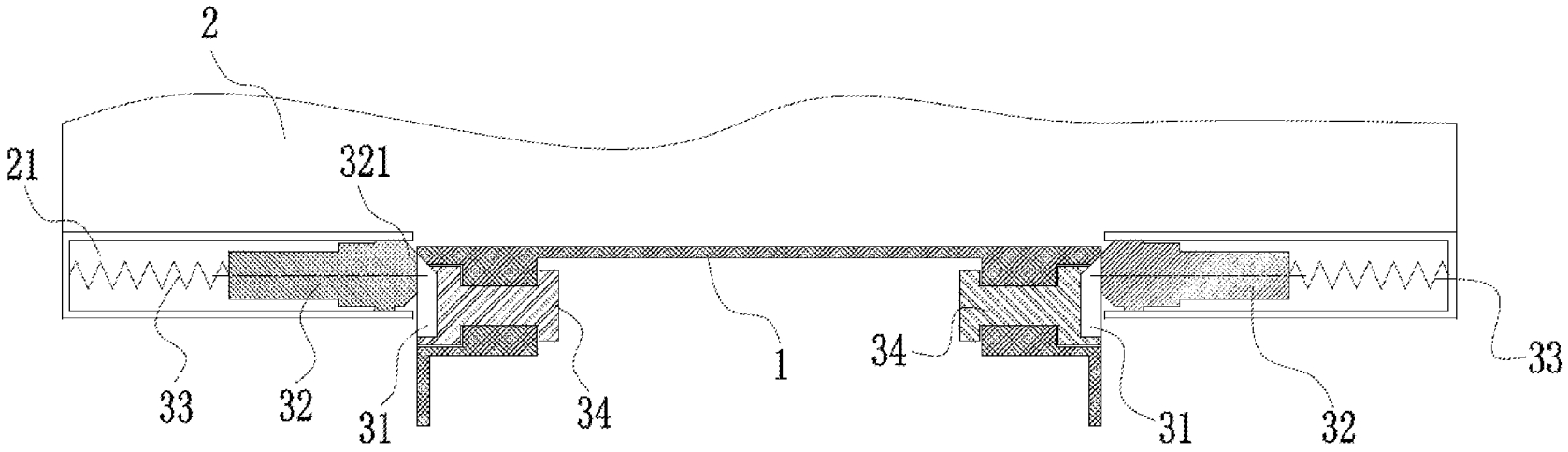
Figure 19:
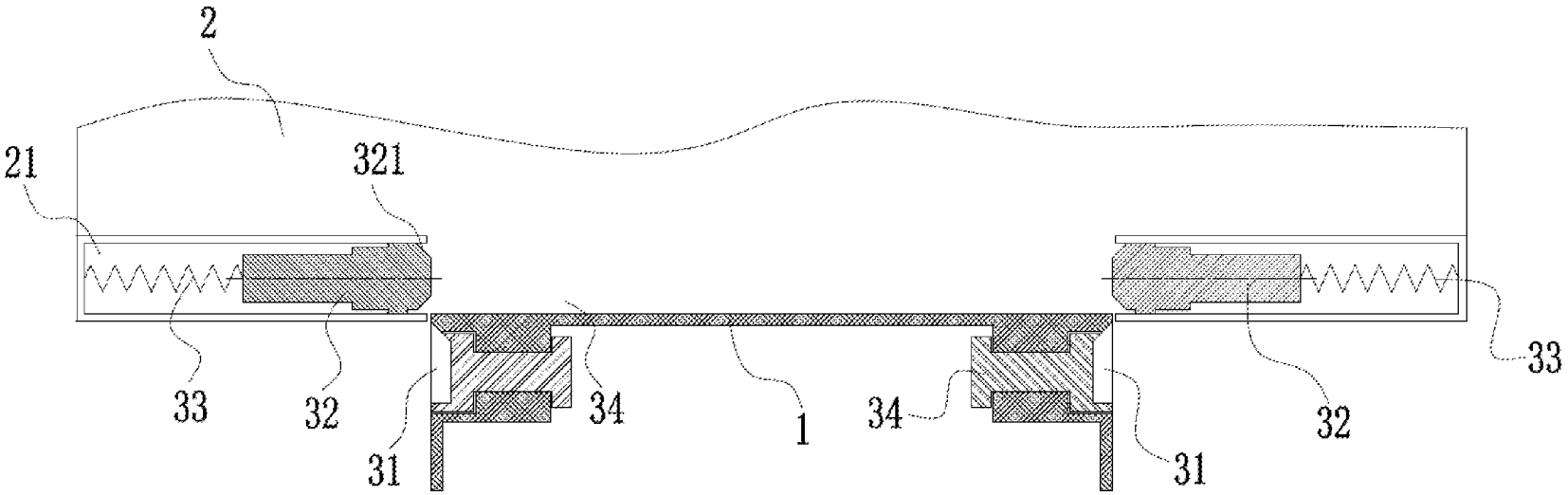

FIG. 1 is a perspective view of a toilet seat according to the present application;

FIG. 2 is a schematic structural view showing a longitudinal section of the toilet seat when a rotating shaft of a connecting mechanism of the toilet seat is at a first position according to the present application;

FIG. 3 is a perspective view of the rotating shaft of the connecting mechanism of the toilet seat according to the present application;

FIG. 4 is a perspective view of an engagement slot and a bushing of the connecting mechanism of the toilet seat according to the present application;

FIG. 5 is a perspective view of the rotating shaft connected to the engagement slot when the rotating shaft of the connecting mechanism of the toilet seat is at a second position according to the present application;

FIG. 6 is a side view of the rotating shaft connected to the engagement slot when the rotating shaft of the connecting mechanism of the toilet seat is at the second position according to the present application;

FIG. 7 is a schematic structural view showing a longitudinal section taken along line A-A in FIG. 6;

FIG. 8 is a perspective view of the toilet seat according to the present application;

FIG. 9 is a perspective view of the rotating shaft connected to the engagement slot when the rotating shaft of the connecting mechanism of the toilet seat is at a third position according to the present application;

FIG. 10 is a side view of the rotating shaft connected to the engagement slot when the rotating shaft of the connecting mechanism of the toilet seat is at the third position according to the present application;

FIG. 11 is a schematic structural view showing a longitudinal section taken along line B-B in FIG. 10;

FIG. 12 is a perspective view of the toilet seat according to the present application;

FIG. 13 is a perspective view of the rotating shaft connected to the engagement slot when the rotating shaft of the connecting mechanism of the toilet seat is located between the second position and the third position according to the present application;

FIG. 14 is a side view of the rotating shaft connected to the engagement slot when the rotating shaft of the connecting mechanism of the toilet seat is located between the second position and the third position according to the present application;

FIG. 15 is a schematic structural view showing a longitudinal section taken along line C-C in FIG. 14;

FIG. 16 is a schematic structural view showing a longitudinal section of a toilet seat when the rotating shaft of the connecting mechanism of the toilet seat is located between the second position and the third position or at the third position according to the present application;

FIG. 17 is a schematic structural view showing a longitudinal section of a toilet seat when the rotating shaft of the connecting mechanism of the toilet seat is located between the first position and the second position according to the present application;

FIG. 18 is a schematic structural view showing a longitudinal section of a toilet seat when the rotating shaft of the connecting mechanism of the toilet seat is at the first position according to the present application; and FIG. 19 is a schematic structural view showing a longitudinal section of the toilet seat after a cover assembly of the toilet seat is detached according to the present application.

DETAILED DESCRIPTION OF EMBODIMENTS

Embodiments of the Present Application

Technical contents of the present application are further explained below in conjunction with the drawings and embodiments.

It is to be noted that description of directions or positions in the present application, for example "above/upper", "below/lower" and "horizontal" and so on, is made with reference to the drawings, however, changes may be made as required, and the changes made are all included in the scope of protection of the present application. In addition, the terms "first", "second" and the like are for purpose of description, and should not be interpreted as indicating or implying relative importance or implying the number of the indicated technical features. Further, "first position" herein refers to a position where the rotating shaft is located in a cover assembly when the cover assembly is at a detachment position, the rotating shaft is retracted into the cover assembly and the cover assembly is not connected to a main body. "Second position" refers to a position where the rotating shaft is located in the cover assembly when the cover assembly is at the detachment position, the rotating shaft is retracted into the cover assembly and the cover assembly is connected to the main body. "Third position" refers to a position where the rotating shaft is located when the cover assembly is at a horizontal position and is connected to the main body. Positions of components of the toilet seat and connection relations therebetween when the rotating shaft is at the first position, the second position and the third position may be described in detail hereinafter.

Reference is made to FIG. 1 which is a perspective view of a toilet seat according to the present application. In a preferred embodiment of the present application, the toilet seat mainly includes a main body 1, a cover assembly 2 and a connecting mechanism 3 (see FIG. 2). The cover assembly 2 is detachably connected to the main body 1, and the cover assembly 2 is rotatable with respect to the main body 1. Preferably, the cover assembly 2 includes an upper cover and a seat ring.

Reference is made to FIG. 2 which is a schematic structural view showing a longitudinal section of the toilet seat according to the present application. As shown in FIG. 2, two transverse sides of the toilet seat both have a connecting mechanism 3. The two connecting mechanisms 3 at two sides of the toilet seat are bilaterally symmetrical about a central line of the toilet seat in a detachment direction for detaching the cover assembly 2 from the main body 1. Only the connecting mechanism 3 at one side is explained below as an example. The connecting mechanism 3 is arranged between the main body 1 and the cover assembly 2. The connecting mechanism 3 is configured to detachably connect the cover assembly 2 to the main body 1. In a preferred embodiment shown in FIG. 2, the connecting structure 3 includes an engagement slot 31, a rotating shaft 32, an elastic component 33 and a bushing 34.

Reference is made to FIGS. 3 to 7, which are respectively a perspective view of the rotating shaft of the connecting mechanism, a perspective view of the engagement slot and the bushing of the connecting mechanism, a perspective view and a side view of the rotating shaft connected to the engagement slot and a schematic structural view of a longitudinal section of the rotating shaft connected to the engagement slot when the cover assembly of the toilet seat is at a detachment position according to the present application. As shown in FIG. 2, FIG. 4 and FIG. 7, the bushing 34 is arranged in the main body 1, and the bushing 34 and the main body 1 form the engagement slot 31. The engagement slot 31 has a main body portion formed by the main body, and the main body portion is provided with a first beveled opening 311. As shown in FIG. 2, the engagement slot 31 is preferably a through slot. The first beveled opening 311 is arranged in the main body 1 (see FIG. 7). The first beveled opening 311 is arranged on an inner surface of the main body portion of the engagement slot 31. In the preferred embodiment shown in FIG. 2, FIG. 4 and FIG. 7, the first beveled opening 311 is arranged along the detachment direction, and the first beveled opening 311 is inclined upward and outward from the inside of the engagement slot 31.

As shown in FIG. 2, a position-limiting groove 21 is provided at a joint where the cover assembly 2 is connected to the main body 1 and is arranged along a transverse direction of the cover assembly 2. The position-limiting groove 21 is configured to permit the rotating shaft 32 and the elastic component 33 to move only in the transverse direction. The rotating shaft 32 is arranged between the cover assembly 2 and the main body 1 and is located in the position-limiting groove 21, and the rotating shaft 32 is movable transversely with respect to the cover assembly 2 between a first position and a second position. When the rotating shaft 32 is at the first position, the rotating shaft 32 is entirely located in the position-limiting groove 21. When the rotating shaft 32 is at the second position, an end of the rotating shaft 32 extends out of the position-limiting groove 21. The rotating shaft 32 shown in FIG. 2 is at the second position. Further, as shown in FIG. 2, FIG. 3 and FIG. 7, an engagement portion 321 is provided on an end surface of an end of the rotating shaft 32. The engagement portion 321 is a protrusion protruding from the end surface of the end of the rotating shaft 32. When the rotating shaft 32 is at the second position, the engagement portion 321 is arranged in the detachment direction and is located in the engagement slot 31. When the rotating shaft 32 moves upward, the engagement portion 321 first comes into contact with the first beveled opening 311 of the engagement slot 31 (as shown in FIG. 2), and then when the rotating shaft 32 continues to move upward, the engagement portion 321 is subjected to a transverse force component from the first beveled opening 311, which may push the rotating shaft 32 to the first position (see positions of the rotating shaft 32 in FIGS. 18 and 19).

Further, in a preferred embodiment of the present application, the engagement portion 321 is provided with a second beveled opening 322 corresponding to the first beveled opening 311 inside the engagement slot 31, as shown in FIG. 7. The second beveled opening 322 is preferably inclined upward from a shaft center of the rotating shaft 32 towards an edge of the rotating shaft 32. The second beveled opening 322 is capable of cooperating with the first beveled opening 311, to push the rotating shaft 32 to the first position when the rotating shaft 32 move upward.

Further, as shown in FIGS. 5 and 6, the rotating shaft 32 can rotate synchronously with the cover assembly 2. In FIG. 6, a rotation direction of the rotating shaft 32 rotating along with the cover assembly 2 is a clockwise direction. Specifically, when the rotating shaft 32 is at the second position, the rotating shaft 32 can rotate synchronously with the cover assembly 2 to a third position (positions of the rotating shaft shown in FIGS. 14 and 15 are between the second position and the third position, and positions of the rotating shaft shown in FIGS. 9 and 10 are the third position). It may be understood that a transverse distance between the third position and the first position is equal to a transverse distance between the second position and the first position. When the rotating shaft 32 rotates from the second position, or is located between the second position and the third position or is at the third position, the rotating shaft 32 cannot move to the first position, and the engagement portion 321 is confined in the engagement slot 31 and cannot move upward, and thus the cover assembly 2 cannot be detached from the main body 1.

The elastic component 33 is located within the position-limiting groove 21 and is connected between the cover assembly 2 and the rotating shaft 32, and is configured to drive the rotating shaft 32 to move transversely from the first position to the second position. Preferably, as shown in FIG. 2, the elastic component 33 is a spring, and the spring has one end connected to the cover assembly 2 and another end connected to the rotating shaft 1.

The bushing 34 is arranged in the main body 1 and configured to abut against the engagement portion 321 of the rotating shaft 32. As shown in FIG. 7, the bushing 34 includes a third beveled opening 341 matching the first beveled opening 311. When the rotating shaft 32 moves upward, the third beveled opening 341 cooperates with the first beveled opening 311 to guide the rotating shaft 32 to move from the second position to the first position. As shown in FIG. 7, the third beveled opening 341 may be considered as an extension, extending toward the inside of the main body 1, of the first beveled opening 311.

Further, referring to FIGS. 1 to 7, when the rotating shaft 32 is at the second position, the cover assembly 2 is at the detachment position. In this state, the engagement portion 321 of the rotating shaft 32 is located in the engagement slot 31, and when the cover assembly 2 drives the rotating shaft 32 to move upward in the detachment direction, the engagement portion 321 of the rotating shaft 32 moves to the first position under the action of the first beveled opening 311, and in turn, the cover assembly 2 can be detached from the main body 1 in the detachment direction.

Further, a method for detaching the cover assembly of the toilet seat described above is also provided according to the present application. Reference is made to FIGS. 8 to 19 which are respectively a perspective view of the toilet seat and a schematic structural view of a longitudinal section of the toilet seat, a perspective view and a side view of the connecting mechanism and a schematic structural view of a longitudinal section of the connecting mechanism in the whole process that the cover assembly of the toilet seat rotates from the horizontal position to the detachment position and then is detached from the main body according to present application.

Reference is made to FIGS. 8 to 11 which are respectively a perspective view of the toilet seat when the cover assembly of the toilet seat is at the horizontal position, a perspective view and a side view of the rotating shaft connected to the engagement slot and a schematic structural view of a longitudinal section of the rotating shaft connected to the engagement slot according to the present application. When the cover assembly 2 is at the horizontal position, the rotating shaft 32 is at the third position. Since the first beveled opening 311 is arranged in the detachment direction and the position of the engagement portion 321 of the rotating shaft 32 at the third position does not correspond to the position of the first beveled opening 311, the engagement portion 321 is restricted by the engagement slot 31 and cannot move upward (see FIG. 11), and in turn, the cover assembly 2 connected to the rotating shaft 32 by the elastic component 33 cannot move upward. In this state, the cover assembly 2 cannot be detached from the main body 1.

Reference is made to FIGS. 12 to 15 which are respectively a perspective view of the toilet seat when the cover assembly of the toilet seat is rotated to a position between the detachment position and the horizontal position, a perspective view and a side view of the rotating shaft connected to the engagement slot and a schematic structural view of a longitudinal section of the rotating shaft connected to the engagement slot according to the present application. When the cover assembly 2 is rotated to the position between the detachment position and the horizontal position, the rotating shaft 32 is accordingly rotated to a position between the second position and the third position. Similar to the case when the rotating shaft 32 is at the third position, since the first beveled opening 311 is arranged in the detachment direction and the position of the engagement portion 321 of the rotating shaft 32 between the second position and the third position does not correspond to the position of the engagement slot 31, the engagement portion 321 is still restricted by the engagement slot 31 and cannot move upward (see FIG. 15), and in turn, the cover assembly 2 connected to the rotating shaft 32 by the elastic component 33 cannot move up. In this state, the cover assembly 2 also cannot be detached from the main body 1.

Therefore, if it is required to detach the cover assembly 2 from the main body 1, it is required to rotate the cover assembly 2 to the detachment position, and then to rotate the rotating shaft 32 to the second position accordingly.

Reference is made to FIG. 2 and FIGS. 16 to 19 which are respectively schematic structural views of the longitudinal section of the toilet seat in the whole process when the cover assembly is rotated from the horizontal position to the detachment position and then detached from the main body. As shown in FIG. 2 and FIG. 16, when the rotating shaft 32 is rotated from a position between the second position and the third position or from the third position (shown in FIG. 16) to the second position (shown in FIG. 2), the engagement portion 321 of the rotating shaft 32 is rotated to a position where the engagement portion 321 is arranged in the detachment direction, to allow the engagement portion 321 to abut against the first beveled opening 311 arranged in the detachment direction. Therefore, when the rotating shaft 32 moves upward, the engagement portion 321 can move along the first beveled opening 311. In this state, by moving the cover assembly 2 upward, the rotating shaft 32 will move upward along with the cover assembly 2. In a process that the engagement portion 321 of the rotating shaft 32 moves along the first beveled opening 311, the first beveled opening 311 applies a transverse force component on the engagement portion 321, and the transverse force component is capable of pushing the rotating shaft from the second position to the first position.

Referring to FIGS. 17 and 18, when the rotating shaft 32 is moved to the first position under the action of the transverse force component applied by the first beveled opening 311 on the engagement portion 321, the rotating shaft 32 completely enters into the position-limiting groove 21, and the cover assembly 2 is not connected to the main body 1 (as shown in FIG. 18). Therefore, by further moving the cover assembly 2 upward, the cover assembly 2 can be separated from the main body 1. As shown in FIG. 19, the cover assembly 2 in FIG. 19 is separated from the main body 1, thus, the detachment of the cover assembly 2 is completed.

Further, a method for installing the cover assembly of the toilet seat described above is further provided according to the present application. It may be understood that installing steps of the cover assembly 2 are reversed relative to detaching steps of the cover assembly 2. Specifically, first the rotating shafts 32 of the two connecting mechanisms 3 at the two sides of the cover assembly 2 and the main body 1 are moved and maintained at the first position, as shown in FIG. 19, in this process, the rotating shafts 32 may be pressed manually to the first position; then, the cover assembly 2 is placed above the joint between the main body 1 and the cover assembly 2; and then the cover assembly 2 is moved downward into alignment with the first beveled opening 311, and in a process when the cover assembly 2 is moved downward in the detachment direction, the rotating shaft 32 is moved downward along with the cover assembly 2 while an elastic force of the elastic component 33 causes the rotating shaft 32 to move in a direction from the first position toward the second position, and when the rotating shaft 32 is located at the second position, the engagement portion 321 of the rotating shaft 32 is located in the engagement slot 31, and thus the cover assembly 2 is connected to the main body 1 in an engagement manner. Thus, installment of the cover assembly 2 is completed.

Further, as set forth in the forgoing description, the detachment position described in the present application is a position where the first beveled opening 311 matches the third beveled opening 341. The detachment direction is a direction in which detachment is performed along the forging detachment position.

In conclusion, in combination with the embodiments shown in FIGS. 1 to 19, it is understood by the person skilled in the art that the toilet seat according to the present application enables a fast detachment and installment of the cover assembly with respect to the main body by providing the connecting mechanisms between the cover assembly and the main body. Therefore, the toilet seat has advantages such as having a high installation efficiency, being convenient for clearing hidden dirt and its cover assembly being easy to detach in maintenance.

Although the present application has been disclosed hereinabove by the preferred embodiments, the preferred embodiments are not intended to limit the present application. Various changes and modifications may be made by the person skilled in the art without departing from the spirit and scope of the present application. Therefore, the scope of protection of the present application is defined by the claims.

INDUSTRIAL APPLICABILITY

The toilet seat according to the present application enables a fast detachment and installment of the cover assembly with respect to the main body by providing the connecting mechanisms between the cover assembly and the main body. Therefore, the toilet seat has advantages such as having a high installation efficiency, being convenient for clearing hidden dirt and its cover assembly being easy to detach in maintenance.

The invention claimed is:

1. A toilet seat, comprising:

a main body;

a cover assembly detachably connected to the main body and rotatable with respect to the main body; and a connecting mechanism arranged between the main body and the cover assembly; and wherein the connecting mechanism is configured to detachably connect the cover assembly to the main body, and the connecting mechanism comprises:

a bushing arranged in the main body, wherein the bushing and the main body form an engagement slot; and a rotating shaft extendable and retractable with respect to the cover assembly, wherein an end of the rotating shaft is provided with an engagement portion, and in a case that the rotating shaft extends out with respect to the cover assembly, the engagement portion is in engagement with the engagement slot to fix the cover assembly to the main body;

wherein the engagement slot has a main body portion formed by the main body and the main body portion is provided with a first beveled opening, the first beveled opening is arranged in a detachment direction of the engagement slot, and in a case that the rotating shaft moves upward in the detachment direction along with the cover assembly, the first beveled opening is configured to guide the rotating shaft to retract into the cover assembly.

2. The toilet seat according to claim 1, wherein the connecting mechanism further comprises an elastic component, and the elastic component has one end fixedly connected to the rotating shaft and another end fixedly connected to the cover assembly, to allow the rotating shaft to extend out with respect to the cover assembly under the action of the elastic component.

3. The toilet seat according to claim 2, wherein the elastic component is a spring, and the spring has one end connected to the cover assembly and another end connected to the rotating shaft.

4. The toilet seat according to claim 1, wherein the rotating shaft is provided with a second beveled opening, and the second beveled opening is configured to cooperate with the first beveled opening to allow the rotating shaft to retract into the cover assembly.

5. The toilet seat according to claim 1, wherein the bushing is provided with a third beveled opening, and the third beveled opening is configured to cooperate with the first beveled opening to allow the rotating shaft to retract into the cover assembly.

6. The toilet seat according to claim 2, wherein a position-limiting groove is provided at a joint where the cover assembly is connected to the main body and is arranged in a transverse direction of the cover assembly, and the elastic component and the rotating shaft are located in the position-limiting groove.

7. The toilet seat according to claim 1, wherein the rotating shaft is rotatable synchronously with the cover assembly.

8. A method for detaching the cover assembly of the toilet seat according to claim 1, comprising:

rotating the cover assembly to a detachment position; and moving the cover assembly upward in the detachment direction, wherein in a process that the cover assembly is moved upward, the rotating shaft is moved upward along with the cover assembly to be retracted into the cover assembly, and then the cover assembly is not connected to the main body to allow the cover assembly to be detached from the main body.

9. A method for installing the cover assembly of the toilet seat according to claim 1, comprising:

moving the rotating shaft and maintaining the rotating shaft within the cover assembly;

placing the cover assembly above a joint between the main body and the cover assembly; and moving the cover assembly downward in the detachment direction, wherein in a process that the cover assembly is moved downward in the detachment direction, the rotating shaft is moved downward along with the cover assembly to extend out of the cover assembly and the engagement portion of the rotating shaft is located in the engagement slot, to connect the cover assembly to the main body in an engagement manner.

* * * * *